United States Patent [19]

Bergen

[11] 4,427,224

[45] Jan. 24, 1984

[54] LATCH BOLT ASSEMBLY WITH SELECTIVELY ADJUSTABLE SPINDLE BACKSET

[75] Inventor: Gary R. Bergen, Yorba Linda, Calif.

[73] Assignee: Emhart Industries, Inc., Farmington, Conn.

[21] Appl. No.: 202,254

[22] Filed: Oct. 29, 1980

[51] Int. Cl.[3] ..... E05C 1/16

[52] U.S. Cl. ..... 292/169.23; 292/1

[58] Field of Search ..... 292/169, 169.22, 169.21, 292/169.23, 1

[56] References Cited

U.S. PATENT DOCUMENTS

| | | | |
|---|---|---|---|
| 2,250,036 | 7/1941 | Schlage | 292/337 |
| 2,299,181 | 10/1942 | Schlage | 292/337 |
| 2,765,187 | 10/1956 | Crandell | 292/1 |
| 2,775,475 | 12/1956 | Miller | 292/1 |
| 2,776,155 | 1/1957 | Gerlach | 292/1 |
| 2,937,897 | 5/1960 | Soderberg | 292/1 |
| 3,046,042 | 7/1962 | Kane | 292/1 |

*Primary Examiner*—Richard E. Moore
*Attorney, Agent, or Firm*—Mahoney & Schick

[57] ABSTRACT

A bolt is movable in a door-mounted casing between extended and retracted positions relative to the door edge by a latch operating mechanism including a transverse half-round spindle. The spindle actuates the latch operating mechanism by engagement with a longitudinally forward engagement surface of an insert assembled with the latch operating mechanism in spindle forward backset position, the motion being transferred longitudinally rearwardly by the insert into the latch operating mechanism and then forwardly to the bolt. The insert is in motion transferring connection with rearward projections of the latch operating mechanism retained in assembly partially by a casing rearward extension and partially by a casing telescoping removable sleeve. Adaption to spindle rearward backset positioning is accomplished by sleeve removal and end for end repositioning, insert transverse removal and sleeve telescoping repositioning in a lesser casing telescoping with the spindle then engaging rearwardly positioned engagement surfaces of the latch operating mechanism transferring motion directly therethrough forwardly to the bolt. The sleeve has a transverse operator opening aligned with the particular insert engagement surfaces or latch operating mechanism engagement surfaces in the alternate sleeve positioning, as well as fastener openings likewise alternately positioned.

20 Claims, 13 Drawing Figures

LATCH BOLT ASSEMBLY WITH SELECTIVELY ADJUSTABLE SPINDLE BACKSET

BACKGROUND OF THE INVENTION

This invention relates to a latch bolt assembly of the type normally used in doors and the like having a unique, selectively adjustable operator backset arrangement. More particularly, this invention relates to such a latch bolt alternate backset arrangement making use of a selectively removable insert for providing the alternate backset dimensions, the insert being included in the assembly for forward or minimum backset dimension and being removed from the assembly for rearward or maximum backset dimension. Thus, the latch bolt assembly including the unique construction principles of the present invention may be selectively converted between minimum and maximum required backset dimensions by a simple conversion procedure, the removal of an insert therefrom.

In conventional use of door-mounted latch constructions, the backset measurement thereof is that distance between forward extremities of the stationary casing longitudinally rearwardly to the transverse axis about which the latch operator, usually a spindle, moves for extending and retracting the bolt of the latch construction from and into the door edge. Such measurement or measurements have, for the most part, been standardized by the industry. With such standardization, it is known when a latch construction is purchased that in a usual installation, the backset measurement will be a standard amount and from a practical standpoint, this measurement will be calculated from the forward exposed surface of usually the latch mounting face plate which, in effect, is the forward extremity of the stationary frame or casing. Again in a usual installation, the face plate is recessed in the door edge with the front surface of the face plate aligned with the door edge so that in most cases, the backset measurement is also the distance from the door edge to the axis of the latch operator.

In the past years, the most prevalent backset has been standardized at two and three-eighths inches so that it has normally been known prior to latch construction installation what the backset measurement would be, thereby permitting standardized original installation and a high degree of interchangeability between various latch constructions. It is true that there have been a few "special" latch constructions having "special" backset measurements, but these have always been considered different and of no overall consequence, except requiring individual considerations for proper installation. However, more recently, a greater and greater percentage of latch constructions are being produced with a greater backset measurement for various reasons including the provision of greater longitudinal length for greater bolt throw, that is, the longitudinal distance that the bolt is moved between retracted and extended position, in order to, in turn, provide increased security.

Therefore, an increased second backset measurement standard has now been adopted by the industry, such second standard being two and three-quarters inches, three-eighths of an inch greater than the previous first standard backset. Most manufacturers of latch constructions have satisfied this demand for the alternate two backset positions by producing and marketing two different and distinct models of many of the latch constructions. One model has a backset measurement of two and three-eighths inches to satisfy the demand for the old standard backset, while the other model has the new standard backset of two and three-quarters inches, all of which is relatively costly in view of the need for manufacturing multiple models.

Thus, there is a distinct want and need in the industry for single models of latch constructions which are relatively quickly and easily selectively adjustable between the two standard backset measurements, that is, between two and three-eighths inches and two and three-quarters inches. Furthermore, such adjustability must be of a relatively simple nature for performing the adjustment manipulation. Latch construction installation is frequently performed by expert workmen well versed in the latch construction field and to them, adjustment simplicity may not be of maximum consequence, but latch construction installation is also performed in an equal, if not greater, number of instances by ordinary homeowners that are not trained in the latch construction field and for them, adjustment simplicity is of maximum importance.

OBJECTS AND SUMMARY OF THE INVENTION

It is, therefore, an object of this invention to provide a latch bolt assembly of the type for door-mounting and the like having integrated therein a unique backset adjustment feature which permits selective adjustment of the mounting backset for the latch bolt assembly between at least two dimensions, a forward or minimum backset and a rearward or maximum backset, the conversion being simply accomplished by those with minimum skills merely through the selective inclusion or removal in the assembly of a relatively simple insert. In a preferred embodiment form, for minimum backset, the insert is included in the assembly and transmits movement of the transverse latch operator rearwardly into a latch operating mechanism, which, in turn, transmits the movement forwardly into the latch bolt. In maximum backset condition, the insert is removed from the assembly and the transverse operator is then directly engaged with the latch operating mechanism so that the movements of the operator are directly transmitted forwardly to the latch bolt.

It is a further object of this invention to provide a latch bolt assembly incorporating the foregoing insert backset convertibility in which, in the preferred embodiment assembly, when the insert is present in the assembly it is at least partially aided for retention of the same in such assembly by a particular formation of the latch bolt latch operating mechanism. As configured, the insert is positioned transversely adjacent a portion of the latch operating mechanism which, in turn, is longitudinally movable within the latch bolt stationary casing. The latch bolt stationary casing has surfaces thereon which are slidably abutted by the insert transversely confining the insert to its assembled position and thereby securely, although selectively removably, retaining the insert in operable position.

It is still a further object of this invention to provide a latch bolt assembly of the foregoing general character and having the backset insert convertibility in which, again in a preferred embodiment form, may include a selectively removable sleeve in the assembly positionable telescoping the latch operating mechanism and which when the insert is present, at least aids in retaining the insert properly positioned and properly movable with the latch operating mechanism. The sleeve telescopes a portion of the stationary latch bolt casing in the assembly transversely confining preferably both a portion of the latch operating mechanism and the insert so as to transversely slidably retain the insert. Selective removal of the insert merely requires the initial selective removal of the telescoping sleeve, all in a simple and efficient manner. Still in a preferred embodiment form, the unique sleeve, in addition to its insert retention functions, may serve still additional functions in the overall latch bolt assembly. For instance, the sleeve may include a transverse opening therethrough for locating the operator, that is, with the insert assembled for a minimum backset dimension, the operator is guided to proper alignment with the insert, and with the insert removed for maximum backset dimension, the sleeve is preferably end for end reversed and retelescoped in a lesser telescoping position guiding the operator to a rearward functioning position. Furthermore, the sleeve preferably includes latch bolt fastener openings transversely therethrough properly aligned with the overall assembly in the alternate sleeve positions for securely retaining the latch bolt assembly properly mounted in the alternate backset positions.

Other objects and advantages of the invention will be apparent from the following specifications and the accompanying drawings which are for the purpose of illustration only.

DESCRIPTION OF THE BEST EMBODIMENT CONTEMPLATED

Figure 1:
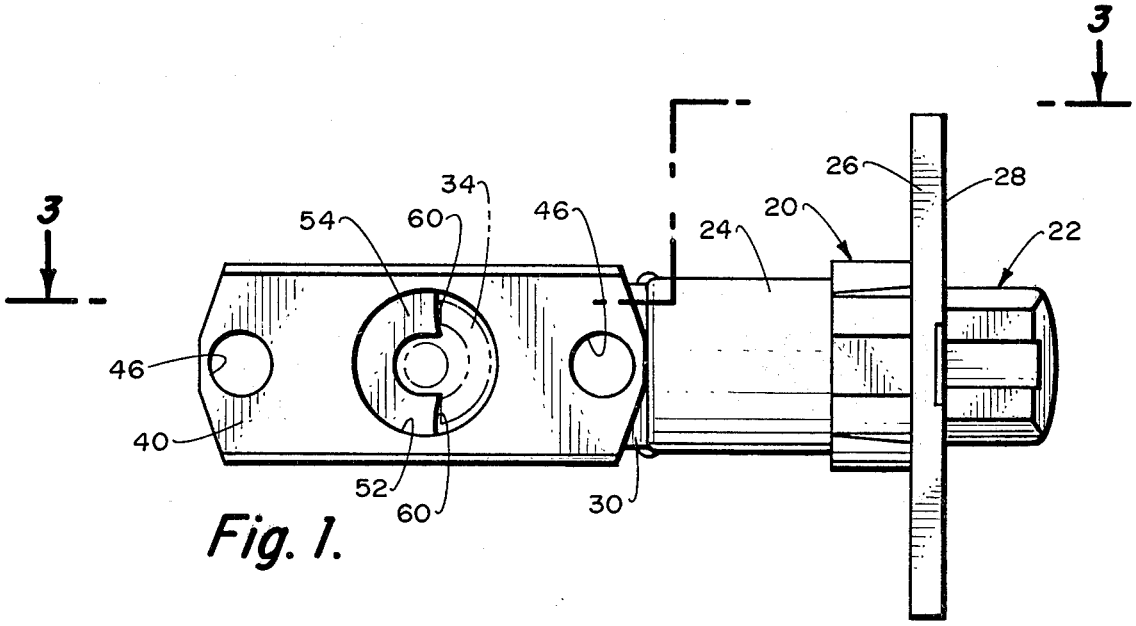
FIG. 1 is a side elevational view of a latch bolt assembly incorporating a preferred embodiment of the backset adjustment principles of the present invention, the latch bolt assembly being shown in bolt extended position and in insert incorporating minimum backset condition.
Figure 2:
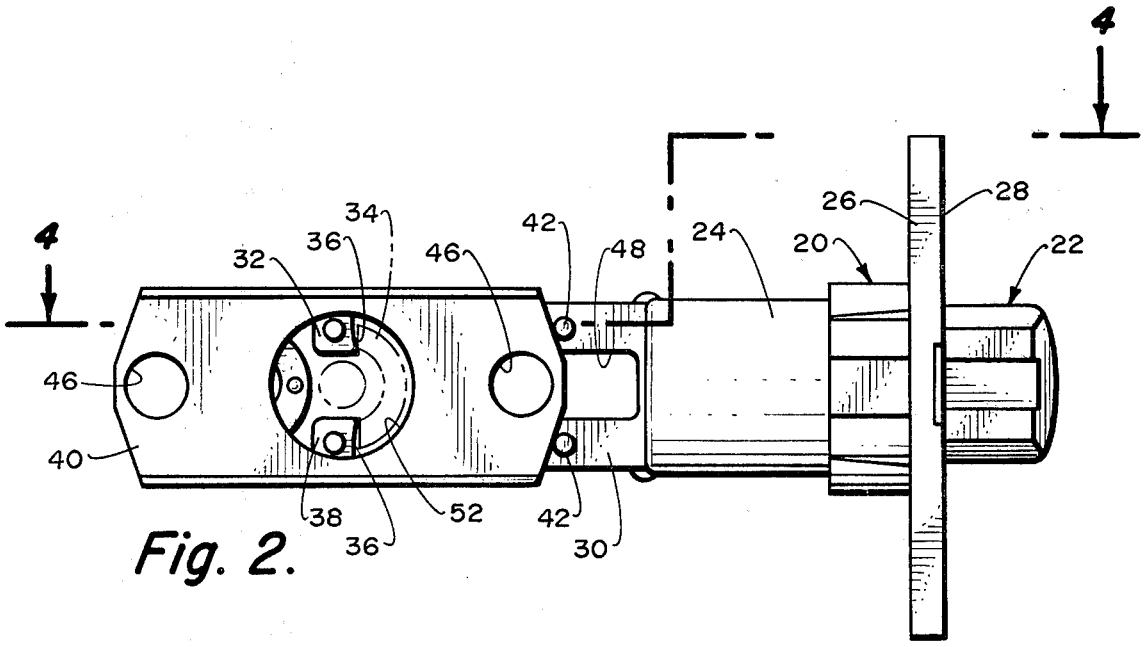
FIG. 2 is a view similar to FIG. 1, but converted to insert removed maximum backset condition.

Referring to the drawings, and initially FIGS. 2, 4, 9 and 10, it will be seen that the basic environment for the selectively adjustable spindle backset improvements of the present invention is illustrated herein as a somewhat conventional latch bolt assembly of the spring latch type. It is pointed out, however, that it is not intended thereby to limit the principles of the present invention to this particular environmental construction, but rather, the principles of the present invention should be broadly construed as applicable to various types and forms of latch bolt assemblies. Furthermore, latch bolt assemblies including the improvements of the present invention may be formed of usual materials and manufactured by usual manufacturing procedures except as hereinafter specifically pointed out, all well known to those skilled in the art.

The spring latch bolt assembly illustrated includes a longitudinally extending, stationary casing generally indicated at 20 longitudinally reciprocally telescoping a bolt generally indicated at 22, the bolt normally being resiliently urged to extended position as illustrated and selectively moved to retracted position substantially fully within the casing. Specifically, the casing 20 is formed by a forward bolt housing 24 connected at its forward extremities to a face plate assembly 26 having a forward face surface 28 and connected rearwardly to a rearward casing extension 30. The bolt 22 is reciprocal within the bolt housing 24 and is rearwardly connected to latch operating means in the form of a latch operating plate 32 projecting rearwardly of the bolt into and telescoped by the rearward casing extension 30.

To the extent described, the latch bolt assembly would be substantially standard and would be received within appropriate formed openings in a door (not shown) with the face plate assembly 26 recessed within the door edge aligning the face surface 28 with the door edge surface, the bolt 22 in extended position projecting from the door edge. The rearward casing extension 30 would be secured to the door securing the overall latch bolt assembly within the door and a transversely extending operator, in this case, a usual half-round spindle 34 would be positioned extending transversely through the door between the door face surfaces and engaged within the rearward casing extension 30 with transversely extending, spaced, engagement surfaces 36 facing forwardly on an operator engagement portion 38 at the rearward extremities of the latch operating plate 32. Thus, rotative motions of the spindle 34 applied by attached door knobs and the like (not shown) would act with rearward forces against the latch operating plate engagement surfaces 36 to move the latch operating plate 32 rearwardly withdrawing the bolt 22 from the extended position shown to a retracted position recessed within the bolt housing 24.

More particularly to the improvements of the present invention, it is pointed out that the backset measurement for latch bolt assemblies is that longitudinal distance from the forward extremities of the casing 20, the face surface 28 of the face plate assembly 26, rearwardly to the transverse axis of the latch operator, the half-round spindle 34. According to the improvements of the present invention, this backset dimension is provided adjustable between at least two dimensions, a forward or minimum backset dimension standardized in the trade at two and three-eighths inches and a rearward or maximum backset dimension standardized in the trade at two and three-quarters inches. In the particular embodiment of latch bolt assembly illustrated, the described operator engagement portion 38 of the latch operating plate 32 becomes the longitudinally rearward operator engagement portion so that when the half-round spindle 34 is engaged therewith, the rearward or maximum backset dimension is being used.

Figure 12:
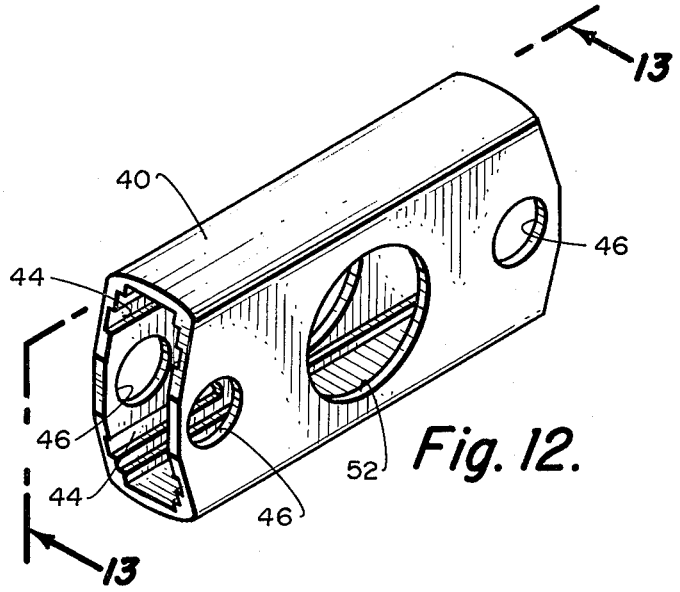
FIG. 12 is an enlarged, perspective view of the sleeve removed from the latch bolt assembly.
Figure 13:
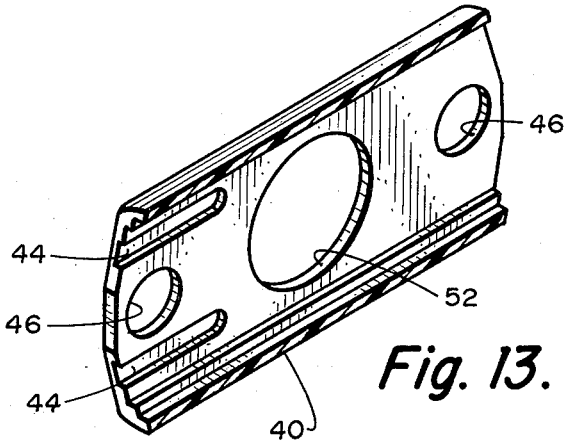
FIG. 13 is a vertical sectional view looking in the direction of the arrows 13—13 in FIG. 12.

The embodiment of the latch bolt assembly adjusted to this rearward or maximum backset dimension is shown in FIGS. 2, 4, 9 and 10. As illustrated, a rigid sleeve 40, preferably formed of rigid plastic, is received forwardly telescoping the rearward casing extension 30 and its enclosed latch operating plate 32, the sleeve forwardly abutting pairs of projections 42 formed on the rearward casing extension 30 spaced rearwardly from the casing bolt housing 24. As shown in FIGS. 12 and 13, the sleeve 40 is formed internally at one end plain and at the other end with pairs of spaced slots 44 registering with the rearward casing extension projections 42 for the reception thereof. In the position shown in FIGS. 2, 4, 9 and 10, the sleeve 40 is turned endwise for the internally plain end thereof to longitudinally face the casing bolt housing 24 thereby causing the rearward casing extension projections 42 to abut the sleeve end retaining the same position as shown.

The sleeve 40 is formed adjacent its ends with fastener openings 46 transversely therethrough, the now forward fastener opening transversely registering with appropriate rearward casing extension and latch operating plate cutouts 48 and 50, and the now rearward fastener opening being spaced rearwardly of both the rearward casing extension 30 and latch operating plate 32. The sleeve 40 longitudinally between the fastener openings 46 is also formed with an operator opening 52 transversely therethrough now properly aligned with the longitudinally rearward operator engagement portion 38 of the latch operating plate 32 and the half-round spindle 34 projecting through the cutouts 48 and 50 engaged with the operator engagement portion engagement surfaces 36. Thus, the latch bolt assembly in this rearward or maximum backset condition may be secured in the particular door (not shown) by the usual fasteners (not shown) received through the fastener openings 46 and the half-round spindle 34 may be properly engaged therewith for movement of the bolt 22 between its extended and retracted positions.

Figure 11:
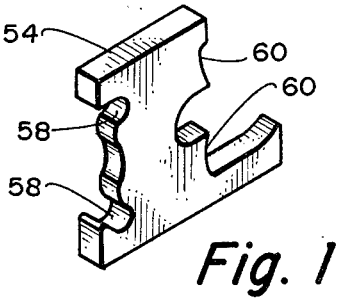
FIG. 11 is an enlarged, perspective view of the selectively removable insert removed from the latch bolt assembly.
Figure 3:
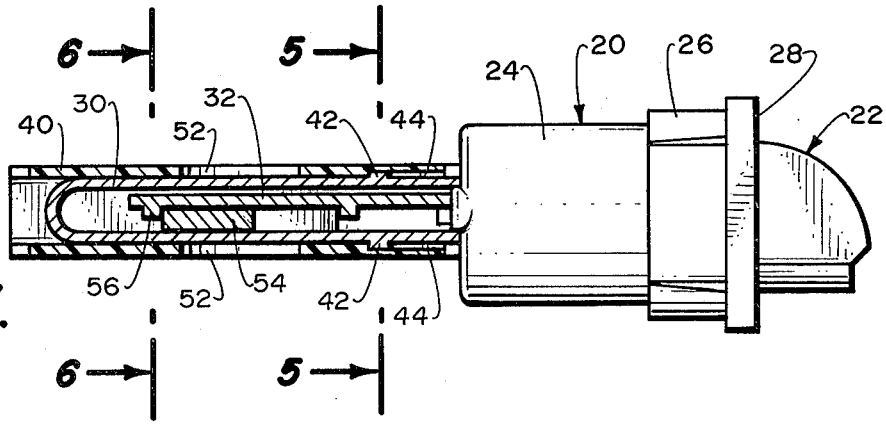
FIG. 3 is a partial horizontal sectional view and a partial top plan view looking in the direction of the arrows 3—3 in FIG. 1.
Figure 4:
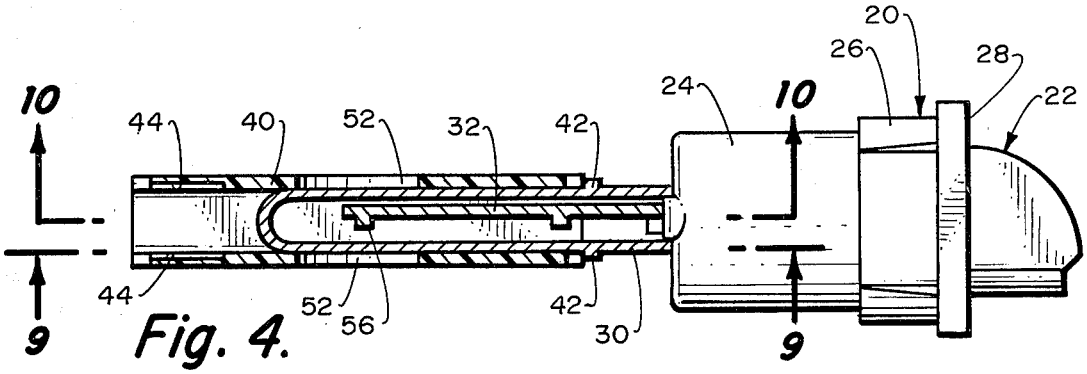
FIG. 4 is a view similar to FIG. 3, but looking in the direction of the arrows 4—4 in FIG. 2.
Figure 5:
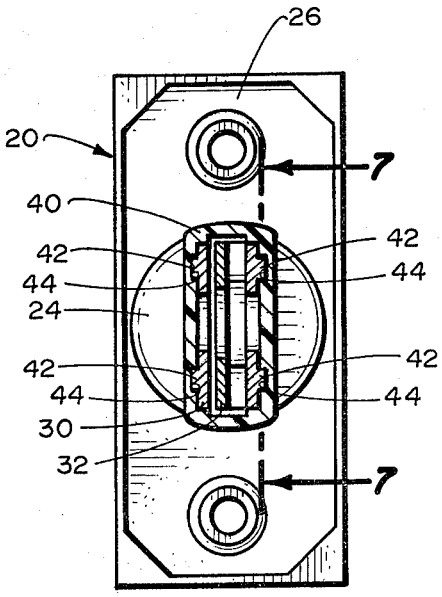
FIG. 5 is a vertical sectional view looking in the direction of the arrows 5—5 in FIG. 3.
Figure 6:
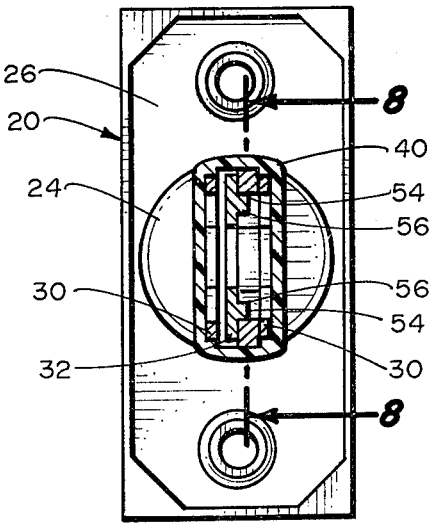
FIG. 6 is a vertical sectional view looking in the direction of the arrows 6—6 in FIG. 3.
Figure 7:
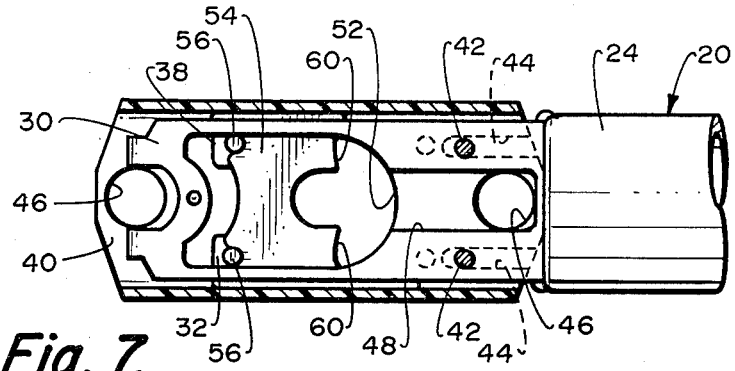
FIG. 7 is a fragmentary, vertical sectional view looking in the direction of the arrows 7—7 in FIG. 5.
Figure 8:
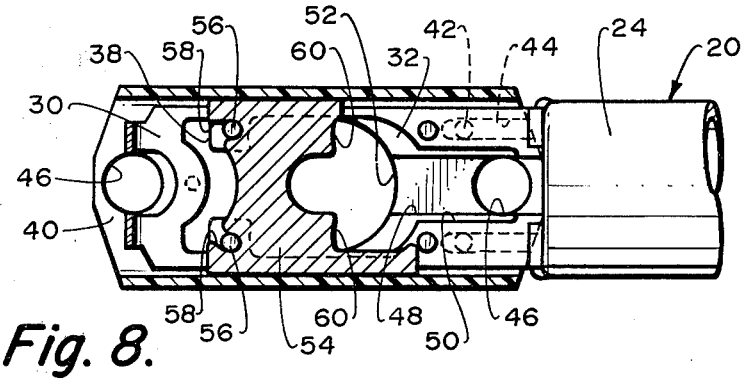
FIG. 8 is a view similar to FIG. 7, but looking in the direction of the arrows 8—8 in FIG. 6.
Figure 9:
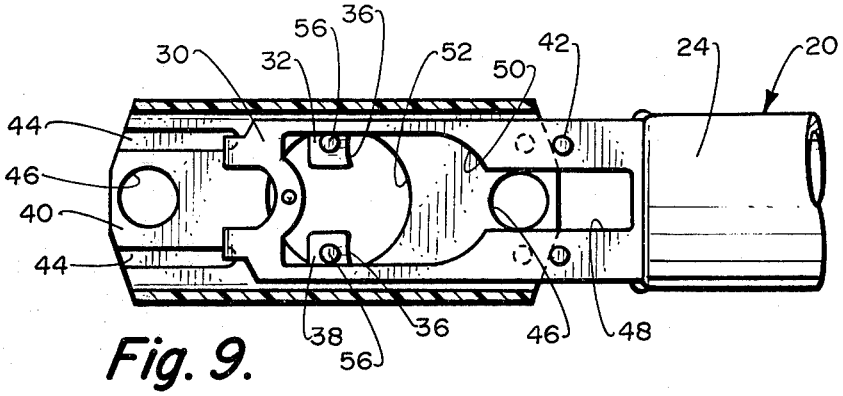
FIG. 9 is a fragmentary, vertical sectional view looking in the direction of the arrows 9—9 in FIG. 4.
Figure 10:
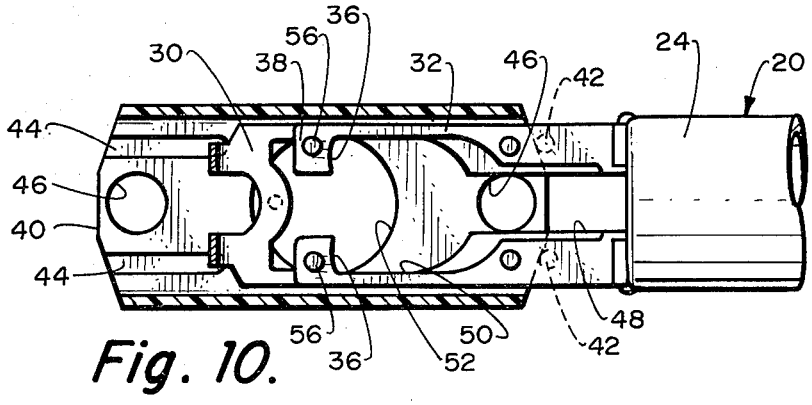
FIG. 10 is a fragmentary, vertical sectional view looking in the direction of the arrows 10—10 in FIG. 4.

Converting the latch bolt assembly from this just described rearward or maximum backset condition to a forward or minimum backset condition, that is, from the condition shown in FIGS. 2, 4, 9 and 10 to the condition shown in FIGS. 1, 3 and 5 through 8, is accomplished by first longitudinally rearwardly removing the sleeve 40 by sliding the same from telescoping the rearward casing extension 30. An insert 54, shown separately in FIG. 11, is then inserted transversely into the assembly within the rearward casing extension 30 engaged with the latch operating plate 32. As shown, the longitudinally rearward operator engagement portion 38 of the latch operating plate 32 has spaced projections 56 and the insert 54 has rearwardly exposed, spaced recesses 58 and forwardly facing operator engagement surfaces 60.

Thus, during transverse insertion of the insert 54 through the rearward casing extension 30 and transversely abutting the latch operating plate 32, the insert recesses 58 are engaged rearwardly over the operator engagement portion projections 56 with the operator engagement surfaces 60 facing forwardly spaced longitudinally forwardly of the operator engagement portion engagement surfaces 36 previously used. The sleeve 40 is then turned end for end and again forwardly longitudinally telescoped over the rearward casing extension 30, but now the sleeve end having the slots 44 is the leading end so that the projections 42 of the rearward casing extension 30 are received in such slots permitting the sleeve to be positioned forwardly fully against the bolt housing 24 as shown. In this insert assembled position, the insert 54 not only abuts surfaces of the latch operating plate 32, but at the opposite side abuts internal surfaces of the rearward casing extension 30 aiding in retaining the insert in assembled position, and with the sleeve 40 telescoped over the entire assembly, it also aids in retaining the insert assembled so as to constitute an overall secure operable retainment thereof. Furthermore, with the sleeve 40 now repositioned at a longitudinally forward advanced position, the operator opening 52 is transversely realigned now with the insert operator engagement surfaces 60 and the sleeve fastener openings 46 are advanced forwardly as shown, for instance, in FIGS. 7 and 8.

The latch bolt assembly is, therefore, now in its forward or minimum backset condition. In such condition, it is installed in a door (not shown) similar to before, but taking into account the required change in backset dimension. The half-round spindle 34 is, of course, now transversely inserted through the newly positioned sleeve operator opening 52 rearwardly engaged with the insert operator engagement surfaces 60 and rotative movement of the spindle will exert the required forces on the sleeve operator engagement surfaces 60 rearwardly through the insert 54 into the latch operating plate 32 at the longitudinally rearward operator engagement portion 38 and then forwardly through the latch operating plate 32 into the bolt 22 for moving the bolt between extended and retracted positions.

From a practical marketing standpoint, the latch bolt assembly incorporating the backset conversion principles of the present invention will preferably be presented for sale in the latter described forward or minimum backset condition, that is, with the insert 54 installed in the assembly and the sleeve 40 end for end oriented with its maximum telescoping of the rearward casing extension 30. This places everything in assembly for the forward or minimum backset dimension ready for consumer installation and use with the minimum backset. However, full instructions are included notifying the consumer that if the rearward or maximum backset condition is required, the simple conversion can be accomplished merely by first telescopic removal of the sleeve 40, then transverse removal of the insert 54 from the assembly, then the end for end repositioning of the sleeve and finally the telescopic repositioning of the sleeve in the lesser telescoped position as positively determined by the rearward casing extension projections 42.

According to the principles of the present invention, therefore, a unique latch bolt assembly is provided having a selectively adjustable operator or spindle backset. Merely with a single latch bolt assembly model, as opposed to the previously required two separate models, either of two backset dimensions may be provided. If the latch bolt assembly incorporating the improvements of the present invention is presented in the marketplace as suggested, the initial backset dimension setting will be the forward or minimum backset setting, presently standardized by the industry at two and three-eighths inches. If, however, the rearward or maximum backset setting is required by the consumer, the simple conversion of the latch bolt assembly is quickly accomplished for the greater backset dimension, it presently being standardized by the industry at two and three-quarters inches.

As hereinbefore pointed out, although the backset adjustment or convertibility principles of the present invention have been herein illustrated in a particular embodiment of latch bolt assembly, it is not intended thereby to limit the principles of the present invention solely to the particular embodiment illustrated. Specifically, the backset adjustment or convertibility principles of the present invention should be broadly construed as applicable to various forms of latch bolt assemblies and should not be limited in scope beyond the specific limitations and the patent equivalents thereof set forth in the appended claims.

I claim:

1. In a latch construction for mounting in doors and the like of the general type having a bolt longitudinally reciprocal in a door-mounted casing between a forward extended position projecting from a door edge and a rearward retracted position substantially fully within the door edge, latch operating means on said casing longitudinally forwardly operably connected to said bolt and longitudinally rearwardly operably connected to an operator thereof, said operating means operator being movable about a transverse axis actuating said operating means to reciprocate said bolt, the longitudinal distance between forward extremities of said casing and said operator axis constituting backset; the improvements comprising: longitudinally rearward operator engagement means on said latch operating means operably connected to said operator when said operator is in a rearward backset position for reciprocating said bolt upon movement of said operator; selectively removable insert means positionable adjacent and connected to said latch operating means extending longitudinally forward of said rearward operator engagement means; longitudinally forward operator engagement means on said insert means spaced longitudinally forwardly of said rearward operator engagement means operably connected to said operator when said operator is in a forward backset position for reciprocating said bolt by transferring motion from said operator upon movement thereof through said insert means into said latch operating means and through said latch operating means to said bolt.

2. In a latch construction as defined in claim 1 in which said insert means is positionable rearwardly connected to said rearward operator engagement means extending forwardly thereof, said longitudinally forward operator engagement means on said insert means reciprocating said bolt by transferring motion from said operator rearwardly through said insert means into said rearward operator engagement means and from said rearward operator engagement means through said latch operating means to said bolt.

3. In a latch construction as defined in claim 1 in which said insert means is selectively removable from position adjacent said latch operating means by transverse movement relative to said latch operating means and is connected to said latch operating means by engagement with transverse projection means on said latch operating means.

4. In a latch construction as defined in claim 1 in which said insert means is positionable rearwardly connected to said rearward operator engagment means extending forwardly thereof by engagement with transverse projection means on said rearward operator engagement means, said insert means being selectively removable transversely of said latch operating means, said longitudinally forward operator engagement means reciprocating said bolt by transferring motion from said operator rearwardly through said insert means into said rearward operator engagement means by said transverse projection means and from said rearward operator engagement means through said latch operating means to said bolt.

5. In a latch construction as defined in claim 1 in which said operator is a half-round spindle having generally transversely extending engagement surfaces formed thereon; in which said longitudinally rearward engagement means on said latch operating means includes transversely extending engagement surfaces on said latch operating means engageable by said operator engagement surfaces when said operator is in a rearward backset position; and in which said longitudinally forward operator engagement means on said insert means includes transversely extending engagement surfaces engageable by said operator engagement surfaces when said operator is in said forward backset position.

6. In a latch construction as defined in claim 1 in which said latch construction casing includes a rearward casing extension extending longitudinally rearwardly adjacent said latch operating means and having surface means thereon at least aiding in removably retaining said insert means adjacent and connected to said latch operating means when said operator is in said forward backset position.

7. In a latch construction as defined in claim 1 in which said latch construction casing includes a rearward casing extension extending longitudinally rearwardly adjacent said latch operating means and having surface means thereon telescoping transversely opposite sides of said latch operating means and said insert means at least aiding in retaining said insert means removably positioned adjacent and connected to said latch operating means when said operator is in said forward backset position.

8. In a latch construction as defined in claim 1 in which a selectively removable sleeve is positionable telescoping said latch operating means and said insert means at least aiding in retaining said insert means removably positioned adjacent and connected to said latch operating means when said operator is in said forward backset position.

9. In a latch construction as defined in claim 1 in which a selectively removable sleeve is positionable telescoping said latch operating means and said insert means, said sleeve being selectively movable to a first longitudinal position at least aiding in retaining said insert means positioned adjacent and connected to said latch operating means when said operator is in said forward backset position, said sleeve being selectively movable to a second longitudinal position when said insert means is removed and said operator is in said rearward backset position.

10. In a latch construction as defined in claim 1 in which a selectively removable sleeve is positionable telescoping said latch operating means and said insert means, said sleeve being selectively movable to a first longitudinal position at least aiding in retaining said insert means positioned adjacent and connected to said latch operating means when said operator is in said forward backset position, said sleeve being selectively movable to a second longitudinal position when said insert means is removed and said operator is in said rearward backset position, said sleeve having an operator opening formed transversely therethrough aligned with said operator in each of said sleeve first and second longitudinal positions.

11. In a latch construction as defined in claim 1 in which said latch construction casing includes a rearward casing extension extending longitudinally rearwardly adjacent said latch operating means and having surface means thereon aiding in removably retaining said insert means adjacent and connected to said latch operating means when said operator is in said forward backset position; and in which a selectively removable sleeve is positionable telescoping said rearward casing extension, said latch operating means and said insert means also aiding in removably retaining said insert means adjacent and connected to said latch operating means when said operator is in said forward backset position, said sleeve remaining stationary with said rearward casing extension during reciprocation of said bolt.

12. In a latch construction as defined in claim 1 in which said latch construction casing includes a rearward casing extension extending longitudinally rearwardly adjacent said latch operating means and having surface means thereon aiding in removably retaining said insert means adjacent and connected to said latch operating means when said operator is in said forward backset position; and in which a selectvely removable sleeve is positionable telescoping said rearward casing extension, said latch operating means and said insert means, said sleeve being selectively movable to a first longitudinal position aiding in retaining said insert means positioned adjacent and connected to said latch operating means when said operator is in said forward backset position, said sleeve being selectively movable to a second longitudinal position when said insert means is removed and said operator is in said rearward backset position, said sleeve remaining stationary with said rearward casing extension during reciprocation of said bolt engaged with abutment means of said casing in each of said first and second longitudinal positions.

13. In a latch construction as defined in claim 1 in which said latch construction casing includes a rearward casing extension extending longitudinally rearwardly adjacent said latch operating means and having surface means thereon aiding in removably retaining said insert means adjacent and connected to said latch operating means when said operator is in said forward backset position; and in which a selectively removable sleeve is positionable telescoping said rearward casing extension, said latch operating means and said insert means, said sleeve being selectively movable to a first longitudinal position aiding in retaining said insert means positioned adjacent and connected to said latch operating means when said operator is in said forward backset position, said sleeve being longitudinally end for end reversable and selectively movable to a second longitudinal position when said insert means is removed and said operator is in said rearward backset position, said casing having abutment means thereon engaged by said sleeve when said sleeve is in each of its first and second longitudinal positions.

14. In a latch construction as defined in claim 1 in which said latch construction casing includes a rearward casing extension extending longitudinally rearwardly adjacent said latch operating means and having surface means thereon aiding in removably retaining said insert means adjacent and connected to said latch operating means when said operator is in said forward backset position; and in which a selectively removable sleeve is positionable telescoping said rearward casing extension, said latch operating means and said insert means, said sleeve being selectively movable to a first longitudinal position aiding in retaining said insert means positioned adjacent and connected to said latch operating means when said operator is in said forward backset position, said sleeve being longitudinally end for end reversable and selectively movable to a second longitudinal position when said insert means is removed and said operator is in said rearward backset position, said casing having abutment means thereon engaged by said sleeve when said sleeve is in each of its first and second longitudinal positions, said sleeve having an operator opening extending transversely therethrough aligned with said operator in each of said first and second longitudinal positions.

15. In a latch construction as defined in claim 1 in which said insert means is positionable rearwardly connected to said rearward operator engagement means extending forwardly thereof, said longitudinally forward operator engagement means on said insert means reciprocating said bolt by transferring motion from said operator rearwardly through said insert means into said rearward operator engagement means and from said rearward operator engagement means through said latch operating means to said bolt; and in which said latch construction casing includes a rearward casing extension extending longitudinally rearwardly adjacent said latch operating means and having surface means thereon at least aiding in removably retaining said insert means adjacent to said latch operating means connected to said rearward operator engagement means when said operator is in said forward backset position.

16. In a latch construction as defined in claim 1 in which said insert means is positionable rearwardly connected to said rearward operator engagement means extending forwardly thereof, said longitudinally forward operator engagement means on said insert means reciprocating said bolt by transferring motion from said operator rearwardly through said insert means into said rearward operator engagement means and from said rearward operator engagement means through said latch operating means to said bolt; in which said latch construction casing includes a rearward casing extension extending longitudinally rearwardly adjacent said latch operating means and having surface means thereon at least aiding in removably retaining said insert means adjacent to said latch operating means connected to said rearward operator engagement means when said operator is in said forward backset position; and in which a selectively removable sleeve is positionable telescoping said rearward casing extension, said latch operating means and said insert means at least aiding in retaining said insert means removably positioned adjacent to said latch operating means rearwardly connected to said rearward operator engagement means when said operator is in said forward backset position.

17. In a latch construction as defined in claim 1 in which said insert means is selectively removable from position adjacent said latch operating means by transverse movement relative to said latch operating means and is connected to said latch operating means by engagement with transverse projection means on said latch operating means; in which said latch construction casing includes a rearward casing extension extending longitudinally rearwardly adjacent said latch operating means and having surface means thereon at least aiding in removably retaining said insert means adjacent to said latch operating means and engaged with said transverse projection means; and in which a selectively removable sleeve is positionable telescoping said rearward casing extension, said latch operating means and said insert means at least aiding in retaining said insert means removably positioned adjacent to said latch operating means and engaged with said transverse projection means.

18. In a latch construction as defined in claim 1 in which said insert means is positionable rearwardly connected to said rearward operator engagement means extending forwardly thereof by engagement with transverse projection means on said rearward operator engagement means, said insert means being selectively removable transversely of said latch operating means, said longitudinally forward operator engagement means reciprocating said bolt by transferring motion from said operator rearwardly through said insert means into said rearward operator engagement means by said transverse projection means and from said rearward operator engagement means through said latch operating means to said bolt; in which said latch construction casing includes a rearward casing extension extending longitudinally rearwardly adjacent said latch operating means and having surface means thereon at least aiding in removably retaining said insert means adjacent to said latch operating means and engaged with said transverse projection means when said operator is in said forward backset position; and in which a selectively removable sleeve is positionable telescoping said rearward casing extension, said latch operating means and said insert means at least aiding in retaining said insert means removably positioned adjacent to said latch operating means and engaged with said transverse projection means when said operator is in said forward backset position.

19. In a latch construction as defined in claim 1 in which said insert means is selectively removable from position adjacent said latch operating means by transverse movement relative to said latch operating means and is connected to said latch operating means by engagement with transverse projection means on said latch operating means; in which said latch construction casing includes a rearward casing extension extending longitudinally rearwardly adjacent said latch operating means and having surface means thereon at least aiding in removably retaining said insert means adjacent to said latch operating means and engaged with said transverse projection means when said operator is in said forward backset position; and in which a selectively removable sleeve is positionable telescoping said rearward casing extension, said latch operating means and said insert means, said sleeve being selectively movable to a first longitudinal position at least aiding in retaining said insert means positioned adjacent to said latch operating means and engaged with said transverse projection means when said operator is in said forward backset position, said sleeve being selectively movable to a second longitudinal position when said insert means is removed and said operator is in said rearward backset position, said sleeve having an operator opening formed transversely therethrough aligned with said operator in each of said sleeve first and second longitudinal positions.

20. In a latch construction as defined in claim 1 in which said insert means is selectively removable from position adjacent said latch operating means by transverse movement relative to said latch operating means and is connected to said latch operating means by engagement with transverse projection means on said latch operating means; in which said latch construction casing includes a rearward casing extension extending longitudinally rearwardly adjacent said latch operating means and having surface means thereon aiding in removably retaining said insert means adjacent to said latch operating means and engaged with said transverse projection means when said operator is in said forward backset position; and in which a selectively removable sleeve is positionable telescoping said rearward casing extension, said latch operating means and said insert means, said sleeve being selectively movable to a first longitudinal position aiding in retaining said insert means positioned adjacent to said latch operating means and engaged with said transverse projection means when said operator is in said forward backset position, said sleeve being longitudinally end for end reversable and selectively movable to a second longitudinal position when said insert means is removed and said operator is in said rearward backset position, said casing having abutment means thereon engaged with said sleeve when said sleeve is in each of its first and second longitudinal positions.

* * * * *